US006089402A

United States Patent [19]

Pracas

[11] Patent Number: 6,089,402

[45] Date of Patent: Jul. 18, 2000

[54] PUZZLE CANDY DISPENSER

[75] Inventor: Victor Manuel Pracas, Waroona Wa, Australia

[73] Assignee: Technovation Australia Pty Ltd, Safety Bay, Australia

[21] Appl. No.: 09/238,787

[22] Filed: Jan. 27, 1999

[30] Foreign Application Priority Data

Feb. 6, 1998 [AU] Australia ..... PP1720

[51] Int. Cl.[7] ..... G07F 11/00; A63F 9/06

[52] U.S. Cl. ..... 221/288; 221/24; 273/153 S; 472/62

[58] Field of Search ..... 221/24, 258, 265, 221/266, 288; 222/456, 547, 548; 273/153; 472/62

[56] References Cited

U.S. PATENT DOCUMENTS

| | | | |
|---|---|---|---|
| 4,484,744 | 11/1984 | Gmunder | 273/153 S |
| 4,553,754 | 11/1985 | Wiggs et al. | 273/153 S |
| 4,754,972 | 7/1988 | Boskovic | 273/153 S X |
| 5,332,221 | 7/1994 | Reed | 273/153 S X |
| 5,664,698 | 9/1997 | Nottingham et al. | 221/258 X |

*Primary Examiner*—Christopher P. Ellis
*Assistant Examiner*—Gene O. Crawford
*Attorney, Agent, or Firm*—Larson & Taylor

[57] ABSTRACT

A puzzle candy dispenser 10 which includes a spherical inner body 12 having a plurality of grooves 14 provided on its outer surface and sized to allow a ball-shaped confection 16 to roll therein. The grooves 14 form a maze between an entry aperture 18 and exit aperture 20 in the outer surface of the inner body 12. A spherical outer shell 22 of slightly larger diameter is adapted to substantially enclose the inner body 12 and has an indentation 24 sufficiently large to allow one of the ball-shaped confections 16 to roll therein when the indentation 24 is located over one of the grooves 14. The ball-shaped confection can be steered by the indentation 24 from the entry aperture 18 through the maze of grooves 14 to the exit aperture 20 by manipulating the outer shell 22 relative to the inner body 12 in order to dispense a confection. A release mechanism 40 is provided for releasing a single candy from a hollow interior of the inner body 12 through the entry aperture 18. A successful user of the candy dispenser has the double satisfaction of solving the puzzle and receiving a candy.

12 Claims, 3 Drawing Sheets

PUZZLE CANDY DISPENSER

FIELD OF THE INVENTION

The present invention relates to a puzzle candy dispenser for dispensing a ball-shaped confection, in which the ball-shaped confection must be steered through a maze in order to dispense the confection.

BACKGROUND TO THE INVENTION

Candy dispensers come in all shapes and sizes. The classic candy dispenser has a transparent spherical container filled with confections which are gravity fed through a bottom aperture into a chamber on which the container is mounted. In order to dispense a candy, a release mechanism is provided in the chamber which is typically designed to release a single confection when operated. Sometimes a coin or other token must be inserted in order to operate the release mechanism. Such candy dispensers are generally not portable, although miniature replicas have been made for domestic use.

Manufacturers of sweet confections are always developing novel and attractive ways of packaging their products in order to improve custom. Generally, the packaging is designed to enable quick and easy dispensing of individual or multiple units of the confection. On the other hand, toy manufacturers are always developing novel puzzles, such as RUBICS CUBE™, which provide hours of amusement and challenge in trying to solve the puzzle. Generally, such puzzles have at least one solution which is aesthetically pleasing and/or intellectually satisfying and hence provide a "reward" for the solver of the puzzle.

SUMMARY OF THE INVENTION

The present invention was developed with a view to providing a puzzle candy dispenser that combines the amusement and challenge of a puzzle with a novel and attractive means of dispensing confections.

According to the present invention there is provided a puzzle candy dispenser for dispensing a ball-shaped confection, the dispenser comprising:

- a spherical inner body having a plurality of grooves provided on its outer surface and sized to allow the ball-shaped confection to roll therein in an operative condition of the dispenser, the plurality of grooves forming a maze between an entry aperture and an exit aperture in the outer surface of the inner body; and,
- a spherical outer shell of slightly larger diameter than the inner body and adapted to substantially enclose the inner body within its hollow interior, the outer shell having an indentation sufficiently large to allow the ball-shaped confection to roll therein when the indentation is located over the groove in the outer surface of the inner body in the operative condition of the dispenser whereby, in use, the ball-shaped confection must be steered by the indentation from the entry aperture through the maze to the exit aperture by manipulating the inner body relative to the outer shell in order to dispense a confection.

Preferably said outer shell has an opening through which said inner body can be touched by a finger to manipulate the inner body relative to the outer shell. Typically said opening is located diametrically opposite said indentation. Typically said outer shell is substantially opaque so that said inner body is only visible through limited areas of said outer shell, including said opening.

Preferably said inner body has a hollow interior adapted to contain a plurality of said ball-shaped confections. Advantageously said inner body also has a release mechanism for releasing one of said ball-shaped confections from the interior of the inner body through said entry aperture. In a preferred embodiment said release mechanism includes a plunger which is slidably mounted in the inner body so as to be accessible through said opening in the outer shell when properly aligned, the plunger including a shaft that extends diametrically through the inner body to said entry aperture. Preferably the plunger shaft is moveable between a closed position in which it blocks the entry aperture and prevents a confection from passing through from the interior of the inner body, and an open position in which it releases a single confection through said entry aperture. Advantageously said plunger is resiliently biased to normally keep the shaft in the closed position.

BRIEF DESCRIPTION OF THE DRAWINGS

In order to facilitate a more comprehensive understanding of the nature of the invention a preferred embodiment of the puzzle candy dispenser will now be described in detail, by way of example only, with reference to the accompanying drawings, in which.

DETAILED DESCRIPTION OF PREFERRED EMBODIMENT

Figure 1:
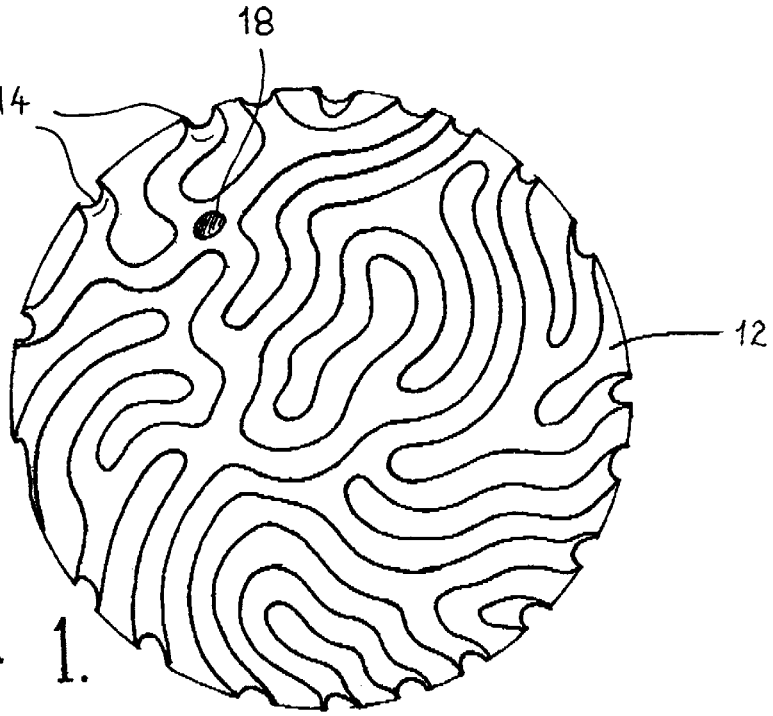
FIG. 1 illustrates a preferred embodiment of a spherical inner body of the puzzle candy dispenser in accordance with the present invention.
Figure 6:
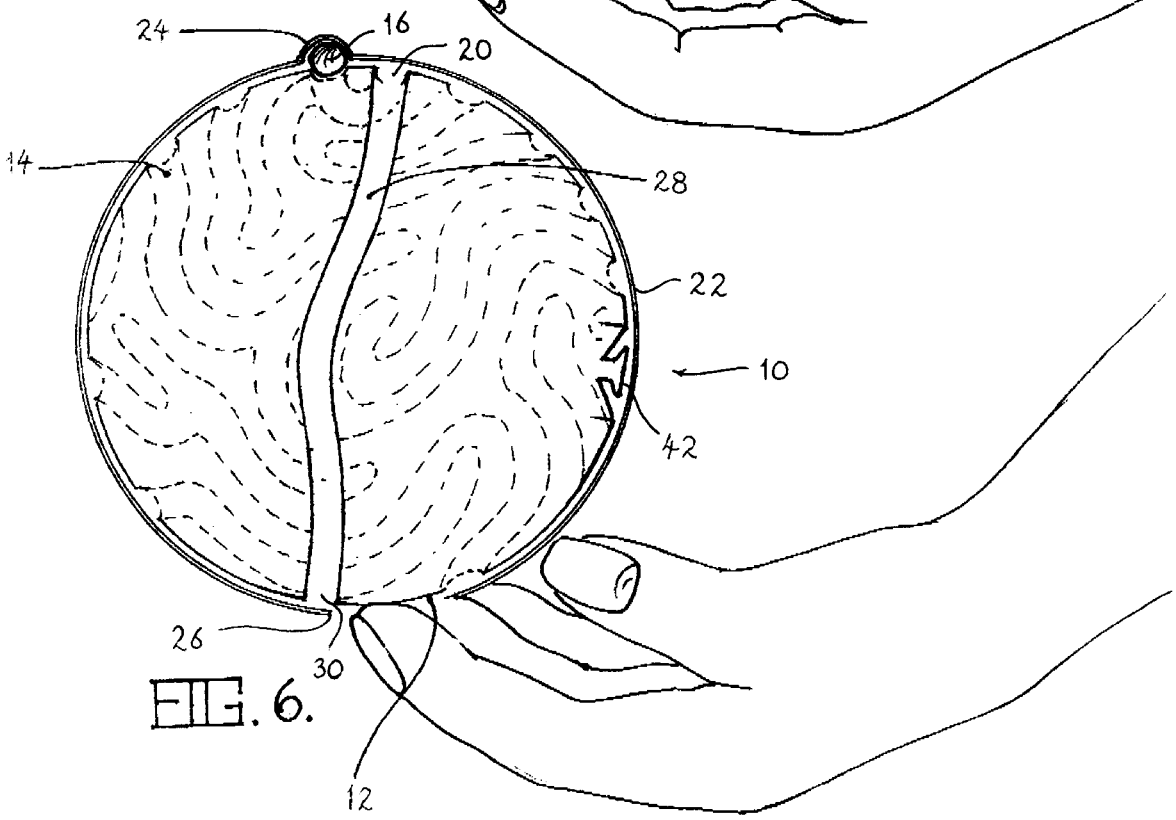

A preferred embodiment of the puzzle candy dispenser 10 as illustrated in the accompanying drawings comprises a spherical inner body 12, illustrated most clearly in FIG. 1. The inner body 12 has a plurality of grooves 14 provided on its outer surface and sized to allow a ball-shaped confection 16 to roll therein in an operative condition of the dispenser 10 as shown in FIG. 6. The grooves 14 on the outer surface of the inner body 12 form a maze between an entry aperture 18 and an exit aperture 20 in the outer surface of the inner body 12. The dispenser 10 further comprises a spherical outer shell 22 of slightly larger diameter than the inner body 12 and adapted to substantially enclose the inner body 12 within its hollow interior as can be seen most clearly in FIG. 6. The outer shell 22 has an indentation 24 sufficiently large to allow one of the ball-shaped confections 16 to roll therein when the indentation is located over a groove 14 in the outer surface of the inner body 12 as shown in FIG. 6. Indentation 24 forms a protrusion on the outer surface of the outer shell 22. The ball-shaped confection 16 can be steered by the indentation 24 from the entry aperture 18 through the maze of grooves 14 to the exit aperture 20 by manipulating the outer shell 22 relative to the inner body 12 in order to dispense a confection.

Figure 5:
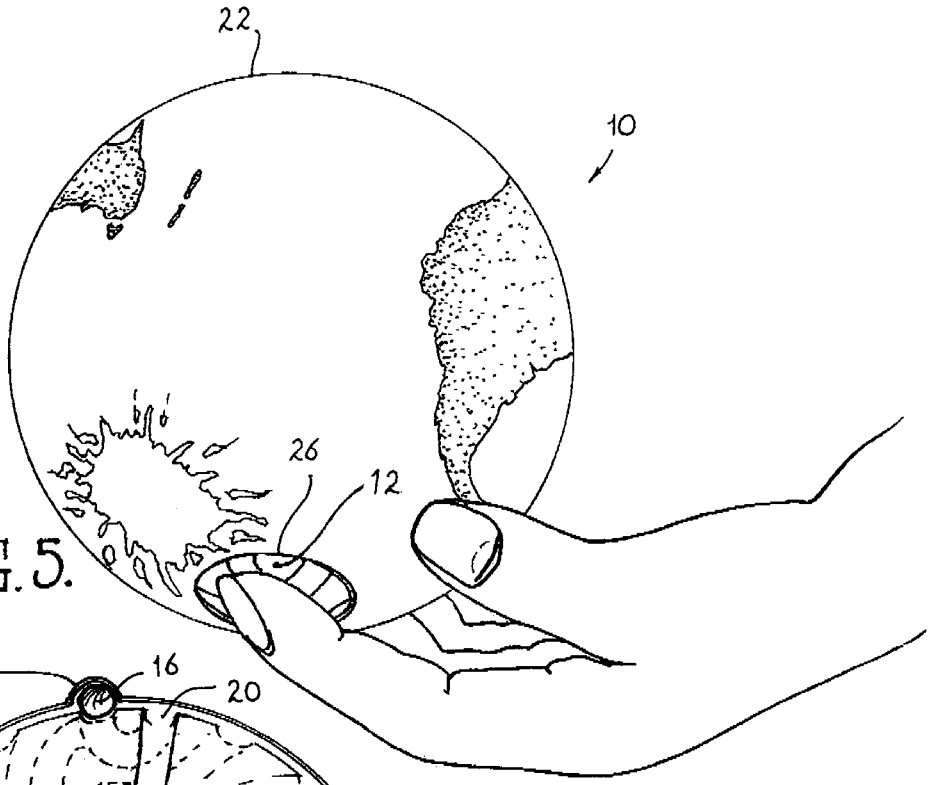

As can be seen most clearly in FIGS. 5 and 6 the outer shell 22 has an opening 26 through which the inner body 12 can be touched by a finger to move the inner body 12 relative to the outer shell 22. In this embodiment, the opening 26 is located diametrically opposite the indentation 24 as can be seen most clearly in FIG. 6. Exit aperture 20 forms the mouth of a tube 28 which passes through the interior of the inner body 12 to a dispensing aperture 30. Hence, when the indentation 24 is located over the exit aperture 20 the ball-shaped confection 16 can exit the maze 20 and roll through tube 28 to the dispensing aperture 30. In this position, the dispensing aperture 30 will be aligned with the opening 26 in the outer shell 22 of the dispenser 10 and hence the confection 16 will be dispensed into the waiting hand of the user.

Figure 2:
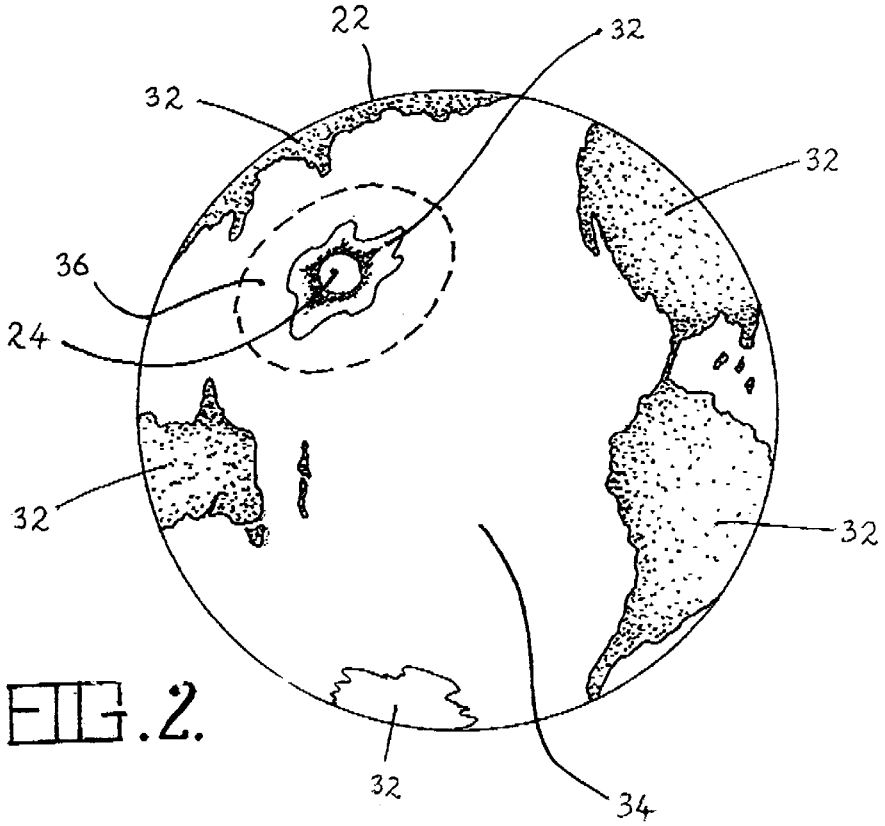
FIG. 2 illustrates a preferred embodiment of a spherical outer shell of a puzzle candy dispenser in accordance with the invention.

In this embodiment of the puzzle candy dispenser 10 the outer shell 22 is substantially opaque. The outer surface of the outer shell 22 has been decorated with a map of the globe and the various continents 32 are clearly visible in FIGS. 2 and 5. The oceans 34 between the continents 32 are painted blue and are also substantially opaque except for a small circular region 36 surrounding the indentation 24. Circular region 36 and the indentation 24 are substantially transparent so that a user can see the ball-shaped confection 16 and a small region of the outer surface of the inner body 12. In this way, the user can steer the confection 16 through one or more of the grooves 14 that may be visible through the transparent region 36, but he/she cannot see where the groove may ultimately lead. Hence, the grooves 14 function like a true maze in which it is not possible to see ahead in order to determine which groove will ultimately lead to the desired destination (exit aperture 20).

Figure 3:
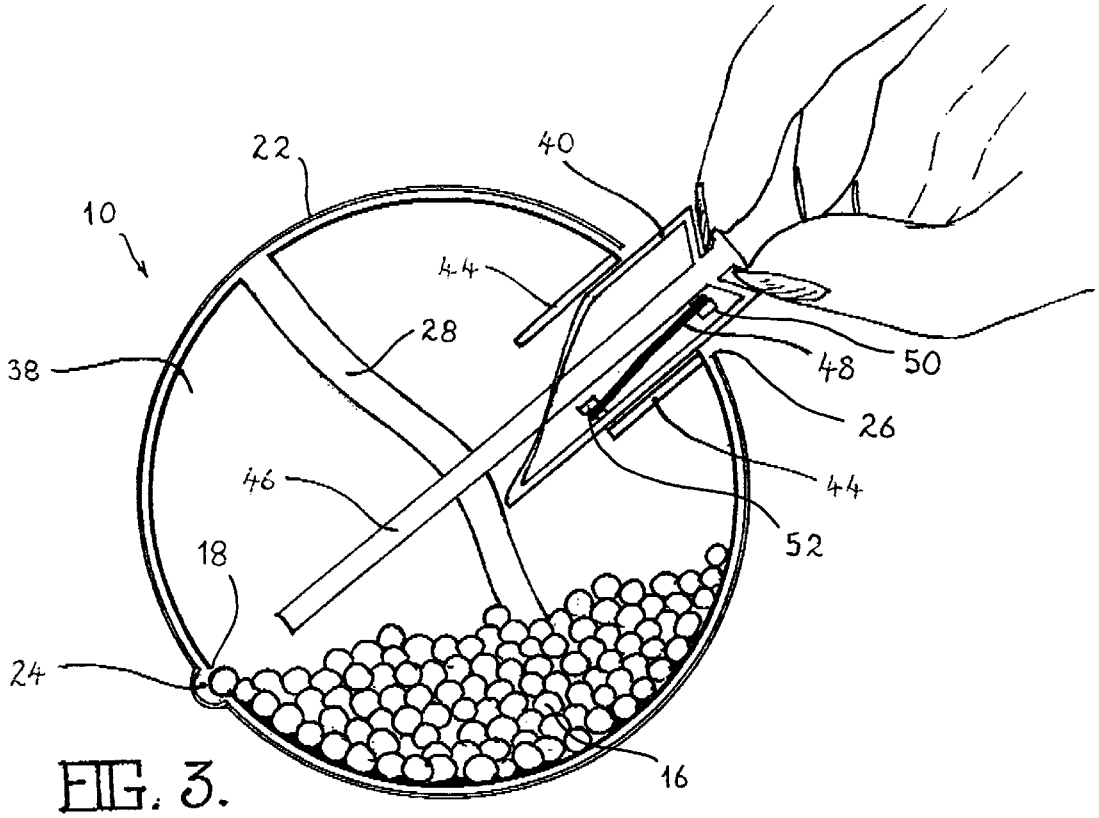
FIGS. 3 and 4 are section views through the preferred embodiment of the puzzle candy dispenser in accordance with the invention; and, FIGS. 5 and 6 illustrate the manner in which the inner body of the candy dispenser of FIGS. 3 and 4 can be manipulated within the outer shell in order to dispense a confection.
Figure 4:
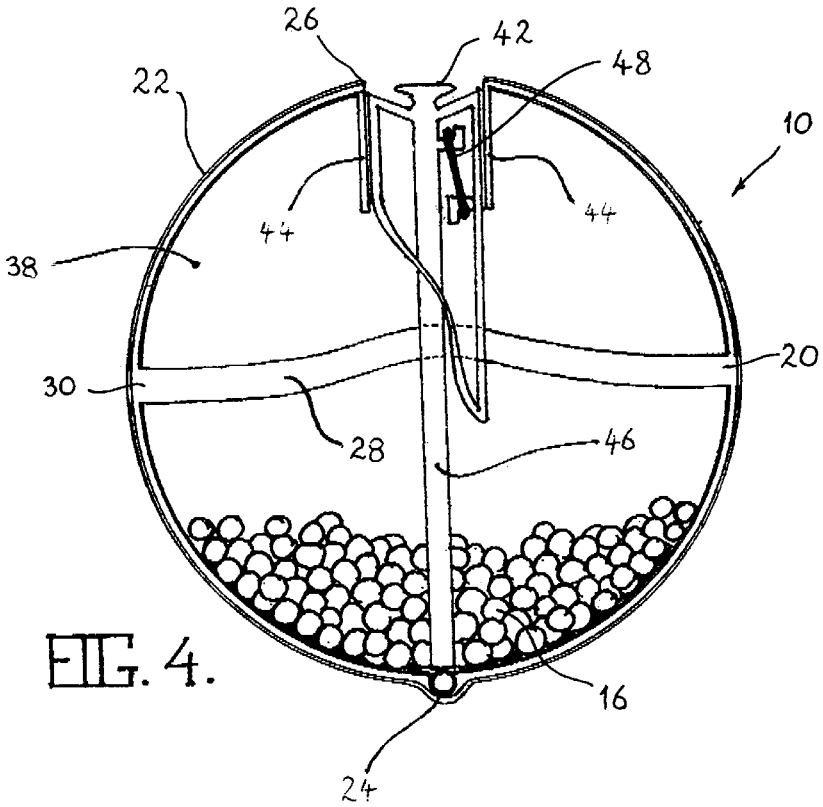

The inner body 12 of this embodiment has a hollow interior 38 as can be seen most clearly in FIGS. 3 and 4. The hollow interior 38 may be used to store a plurality of the ball-shaped confections 16 so that the candy dispenser 10 effectively becomes a packaging for the confections 16. A release mechanism 40 is provided in the inner body 12 for releasing one of the ball-shaped confections 16 from the interior 38 of the inner body through the entry aperture 18. In this embodiment the release mechanism 40 is in the form of a plunger which is slidably mounted in the inner body 12 so as to be accessible through the opening 26 and the outer shell 22 when properly aligned as shown in FIGS. 3 and 4. A small finger grip 42 is recessed into the top of the plunger 40 to enable the plunger 40 to be withdrawn manually through opening 26 as shown in FIG. 4. A short cylinder 44 is provided within the hollow interior 38 of the inner body 12 for slidably receiving the plunger 40 therein.

The plunger 40 includes a shaft 46 which extends diametrically through the hollow interior 38 of the inner body 12 to the entry aperture 18. The shaft 46 is moveable between a closed position as shown in FIG. 4 in which it blocks the entry aperture 18 and prevents a confection 16 from passing through from the hollow interior 38, and an open position as shown in FIG. 3 in which it releases a single confection 16 through the entry aperture 18. It will be appreciated that one of the confections 16 only can pass through the entry aperture 18 when the aperture 18 is aligned with the indentation 24. Otherwise, the inner surface of the outer shell 22 will prevent the confection 16 from passing through the entry aperture 18. Grooves 14 on the outer surface of the inner body 12 are not sufficiently deep to allow one of the confections 16 to roll therein. In any case, release mechanism 40 can only be accessed through opening 26 when the entry aperture 18 is correctly aligned with the indentation 24. At all other times, the release mechanism 40 will be concealed from view within the outer shell 22. The finger grip 42 is of sufficiently low profile, as shown in FIG. 4, that it does not extend beyond the outer surface of the inner body 12 in its closed position.

Plunger 40 is resiliently biased by a rubber band 48 to normally keep the shaft 46 in the closed position. Rubber band 48 is looped about a first hook 50 provided on the shaft 46 and a second hook 52 provided on the short cylinder 44. As can be seen in FIGS. 3,4 and 6 the tube 28 which extends between the entry aperture 20 and exit aperture 30 is bent so that it curves around the shaft 46 and does not interfere with the free movement thereof between the open and closed positions.

In order to operate the puzzle candy dispenser 10, the user first manipulates the inner body 12 relative to the outer shell 22 by touching the outer surface of the inner body 12 with a finger through opening 26 as shown in FIGS. 5 and 6. Until such time as a confection is released through the entry aperture 18, the inner body 12 can be rotated freely within the outer shell 22 in order to align the finger grip 42 of plunger 40 with the opening 26 in the outer shell 22. In this position, the entry aperture 18 is aligned with the indentation 24 and when the plunger 40 is withdrawn as shown in FIG. 3 to the open position, a single ball-shaped confection 16 is released through aperture 18 into the indentation 24. The plunger 40 is then returned to the closed position as shown in FIG. 4 and a single confection 16 will be left in indentation 24 as there is insufficient room for any additional confections. Inner body 12 can now only be manipulated relative to the outer shell 22 to the extent that the confection 16 is steered along the grooves 14 provided on the outer surface of the inner body 12. The object is for the user to find the correct path to the exit aperture 20 which will enable the confection 16 to pass through the tube 28 to the dispensing aperture 30 and into the user's hand. The user will therefore have the double satisfaction of solving the puzzle and receiving a confection as a reward for his/her effort. If desired, the outer surface of the inner body 12 may also be provided with one or more false exit apertures which are not connected to the dispensing aperture 30 but return the confection back to the hollow interior 38 instead. When the correct exit aperture 20 has been found and the confection 16 dispensed from the puzzle candy dispenser 10, the inner body 12 will again freely rotate within the outer shell 22 and the user can release another confection 16 from the hollow interior 38 using the release mechanism 40 as described above. In this embodiment, once all of the confections 16 within the hollow interior 38 have been exhausted, the dispenser cannot be filled. If it is desired to reduce the degree of difficulty in solving the puzzle, larger regions of the outer shell 22 may be made transparent so that more of the maze formed by the grooves 14 is visible to the user.

From the above description of a preferred embodiment of the puzzle candy dispenser, a number of features will commend themselves to both toy manufactures and manufacturers of confections, including the following:

(i) it provides a novel and amusing packaging or dispenser for candy which can provide hours of entertainment;

(ii) it is easy to use but not necessarily easy to solve and the degree of difficulty can be varied by changing the size of the transparent regions in the outer shell 22;

(iii) the double satisfaction of solving the puzzle and receiving a candy makes it more attractive then other novelty puzzles; and, (iv) it is relatively simple and inexpensive to manufacture.

Numerous variations and modifications will suggest themselves to persons skilled in the toy manufacturing and confectionery arts, in addition to those already described, without departing from the basic inventive concepts. For example, quite a different form of release mechanism may be provided which is capable of releasing one or more confections into the maze on the outer surface of the inner body 12. Furthermore, means may be provided for refilling the interior 38 of the inner body 12 with confections if desired. All such variations and modifications are to be considered within the scope of the present invention, the nature of which is to be determined from the foregoing description and the appended claims.

What is claimed is:

1. A puzzle candy dispenser for dispensing a ball-shaped confection, the dispenser comprising:

a spherical inner body having an entry aperture, an exit aperture, and a plurality of grooves provided on its outer surface and sized to allow the ball-shaped confection to roll therein in an operative condition of the dispenser, the plurality of grooves forming a maze between the entry aperture and the exit aperture in the outer surface of the inner body; and, a spherical outer shell of slightly larger diameter than the inner body and adapted to substantially enclose the inner body within its hollow interior, the outer shell having an indentation sufficiently large to allow the ball-shaped confection to roll therein when the indentation is located over the groove in the outer surface of the inner body in the operative condition of the dispenser whereby, in use, the ball-shaped confection must be steered by the indentation from the entry aperture through the maze to the exit aperture by manipulating the inner body relative to the outer shell in order to dispense a confection.

2. A puzzle candy dispenser as defined in claim 1, wherein said outer shell has an opening through which said inner body can be touched by a finger to manipulate the inner body relative to the outer shell.

3. A puzzle candy dispenser as defined in claim 2, wherein said opening is located diametrically opposite said indentation.

4. A puzzle candy dispenser as defined in claim 3, wherein said outer shell is substantially opaque so that said inner body is only visible through limited areas of said outer shell, including said opening.

5. A puzzle candy dispenser as defined in claim 1, wherein said inner body is also provided with dispensing aperture in its outer surface, and has a tube which passes through the interior of the inner body from said exit aperture to said dispensing aperture whereby, in use, when a ball-shaped confection enters the exit aperture it rolls through the tube to be dispensed from the dispensing aperture.

6. A puzzle candy dispenser as defined in claim 5, wherein said dispensing aperture is located diametrically opposite said exit aperture.

7. A puzzle candy dispenser as defined in claim 6, wherein said exit aperture is one of a plurality of exit apertures, only of the plurality of exit apertures being connected to the dispensing aperture via the tube, the other exit apertures being false exits which return the confection to a hollow interior of the inner body.

8. A puzzle candy dispenser as defined in claim 1, wherein said inner body has a hollow interior adapted to contain a plurality of said ball-shaped confections.

9. A puzzle candy dispenser as defined in claim 8, wherein said inner body also has a release mechanism for releasing one of said ball-shaped confections from the interior of the inner body through said entry aperture.

10. A puzzle candy dispenser as defined in claim 9, wherein said release mechanism includes a plunger which is slidably mounted in the inner body so as to be accessible through said opening in the outer shell when properly aligned, the plunger including a shaft that extends diametrically through the inner body to said entry aperture.

11. A puzzle candy dispenser as defined in claim 10, wherein the plunger shaft is moveable between a closed position in which it blocks the entry aperture and prevents a confection from passing through from the interior of the inner body, and an open position in which it releases a single confection through said entry aperture.

12. A puzzle candy dispenser as defined in claim 11, wherein said plunger is resiliently biased to normally keep the shaft in the closed position.

* * * * *